US007187877B2

(12) United States Patent
Yamaguchi

(10) Patent No.: US 7,187,877 B2
(45) Date of Patent: Mar. 6, 2007

(54) IMAGE FORMING APPARATUS WITH DETACHABLE TRANSFER UNIT

(75) Inventor: Yasunaga Yamaguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 183 days.

(21) Appl. No.: 11/020,081

(22) Filed: Dec. 23, 2004

(65) Prior Publication Data

US 2005/0141908 A1 Jun. 30, 2005

(30) Foreign Application Priority Data

Dec. 26, 2003 (JP) ..... 2003-434303

(51) Int. Cl.
*G03G 15/00* (2006.01)

(52) U.S. Cl. ..... 399/37

(58) Field of Classification Search ..... 399/121, 399/37, 90

See application file for complete search history.

(56) References Cited

U.S. PATENT DOCUMENTS 6,404,999 B1 * 6/2002 Shoji et al.

* cited by examiner

*Primary Examiner*—Susan Lee
(74) *Attorney, Agent, or Firm*—Takeuchi & Kubotera, LLP

(57) ABSTRACT

An image forming apparatus includes an apparatus body (48); image bearing bodies (11) for forming electrostatic latent images; a transfer unit (19) opposed to the image bearing bodies and having transfer sections (15); a voltage supply (13) for generating a transfer voltage; a mounting member (12) for bringing the transfer sections (15) into contact with the image bearing bodies (11) when the transfer unit (19) is installed at an appropriate position within the apparatus body (48) and into non-contact with the image bearing bodies (11) when the transfer unit (19) is installed at an inappropriate position within the apparatus body (48); and detection devices (14) for applying the transfer voltage to the transfer sections (15) to detect whether the transfer unit (19) is in contact with the image bearing bodies (11).

15 Claims, 15 Drawing Sheets

| TRANSFER CURRENT | | | | IMAGE FORMING SECTION | | | | TRANS-FER UNIT | MOUNT-ING MEMBER |
|---|---|---|---|---|---|---|---|---|---|
| BLACK | YELLOW | MAGENTA | CYAN | BLACK | YELLOW | MAGENTA | CYAN | | |
| X | X | X | X | UNINST | UNINST | UNINST | UNINST | UNINST | INCOMP |
| O | X | X | X | INSTAL | UNINST | UNINST | UNINST | INSTAL | COMPL |
| X | O | X | X | UNINST | INSTAL | UNINST | UNINST | INSTAL | COMPL |
| X | X | O | X | UNINST | UNINST | INSTAL | UNINST | INSTAL | INCOMP |
| X | X | X | O | UNINST | UNINST | UNINST | INSTAL | INSTAL | INCOMP |
| O | O | X | X | INSTAL | INSTAL | UNINST | UNINST | INSTAL | COMPL |
| O | X | O | X | INSTAL | UNINST | INSTAL | UNINST | INSTAL | COMPL |
| O | X | X | O | INSTAL | UNINST | UNINST | INSTAL | INSTAL | COMPL |
| X | O | O | X | UNINST | INSTAL | INSTAL | UNINST | INSTAL | COMPL |
| X | O | X | O | UNINST | INSTAL | UNINST | INSTAL | INSTAL | COMPL |
| X | X | O | O | UNINST | UNINST | INSTAL | INSTAL | INSTAL | INCOMP |
| O | O | O | X | INSTAL | INSTAL | INSTAL | UNINST | INSTAL | COMPL |
| O | X | O | O | INSTAL | UNINST | INSTAL | INSTAL | INSTAL | COMPL |
| O | O | X | O | INSTAL | INSTAL | UNINST | INSTAL | INSTAL | COMPL |
| X | O | O | O | UNINST | INSTAL | INSTAL | INSTAL | INSTAL | COMPL |
| O | O | O | O | INSTAL | INSTAL | INSTAL | INSTAL | INSTAL | COMPL |

FIG. 11

| TRANSFER CURRENT | | | | IMAGE FORMING SECTION | | | | TRANS-FER UNIT | MOUNT-ING MEMBER |
|---|---|---|---|---|---|---|---|---|---|
| BLACK | YELLOW | MAGENTA | CYAN | BLACK | YELLOW | MAGENTA | CYAN | | |
| X | X | X | X | SENSOR | SENSOR | SENSOR | SENSOR | UNINST | INCOMP |
| O | X | X | X | INSTAL | UNINST | UNINST | UNINST | INSTAL | COMPL |
| X | O | X | X | UNINST | INSTAL | UNINST | UNINST | INSTAL | COMPL |
| X | X | O | X | UNINST | UNINST | INSTAL | UNINST | INSTAL | INCOMP |
| X | X | X | O | UNINST | UNINST | UNINST | INSTAL | INSTAL | INCOMP |
| O | O | X | X | INSTAL | INSTAL | UNINST | UNINST | INSTAL | COMPL |
| O | X | O | X | INSTAL | UNINST | INSTAL | UNINST | INSTAL | COMPL |
| O | X | X | O | INSTAL | UNINST | UNINST | INSTAL | INSTAL | COMPL |
| X | O | O | X | UNINST | INSTAL | INSTAL | UNINST | INSTAL | COMPL |
| X | O | X | O | UNINST | INSTAL | UNINST | INSTAL | INSTAL | COMPL |
| X | X | O | O | UNINST | UNINST | INSTAL | INSTAL | INSTAL | INCOMP |
| O | O | O | X | INSTAL | INSTAL | INSTAL | UNINST | INSTAL | COMPL |
| O | X | O | O | INSTAL | UNINST | INSTAL | INSTAL | INSTAL | COMPL |
| O | O | X | O | INSTAL | INSTAL | UNINST | INSTAL | INSTAL | COMPL |
| X | O | O | O | UNINST | INSTAL | INSTAL | INSTAL | INSTAL | COMPL |
| O | O | O | O | INSTAL | INSTAL | INSTAL | INSTAL | INSTAL | COMPL |

FIG. 18

IMAGE FORMING APPARATUS WITH DETACHABLE TRANSFER UNIT

BACKGROUND OF THE INVENTION

1. Field of the Invention

The present invention relates to image forming apparatus.

2. Description of the Related Art

Conventionally, an image forming apparatus, such as a color printer, copier, or facsimile machine, includes image forming sections for respective colors wherein the surfaces of photosensitive drums are charged and exposed to exposing devices according to image information to form electrostatic latent images, which are developed by developing devices with toners to form toner images for the respective colors. The toner images are transferred and fixed on a recording medium or paper by a fixing unit.

The transfer unit includes a plurality of transfer rollers to which a transfer voltage is applied by a voltage supply and a transfer belt for transporting the paper, and a motor for driving the transfer belt. See JP 10-63049.

If printing is started with the transfer unit not fully installed in the body of a printer, the transfer belt is not driven properly, causing poor transportation of the paper. If the transfer unit is not fully installed, keeping the contact member from connecting the voltage supply and the transfer rollers, it is impossible to transfer the toner image.

The photosensitive drums have a cylindrical shape and are rotated in sync with the running of the transfer belt to transfer the toner image to the paper. If the transfer unit is not fully installed, keeping the photosensitive drum from rotating in sync with the running of the transfer belt, it is impossible to transfer the tone image to the paper accurately. In addition, if a high charging voltage is applied to the photosensitive drum which is at rest, the high voltage is kept to be applied to a local area of the photosensitive drum, causing damage to the photosensitive drum. Thus, a mounting member is provided for each transfer roller to fully install the transfer unit in the printer body by operating the respective mounting members.

However, in the conventional printer, it is impossible to check whether the operation of each mounting member is completed. If a sensor is provided for each mounting member to determine whether the operation of the mounting member is completed, not only the structure of the printer becomes complicated but also the manufacturing cost is increased.

SUMMARY OF THE INVENTION

Accordingly, it is an object of the invention to provide an image forming apparatus enabling one to check whether the transfer unit is installed and to simplify the structure and reduce the manufacturing cost.

According to the invention there is provided an image forming apparatus which includes an apparatus body; image bearing bodies for forming electrostatic latent images; a transfer unit opposed to the image bearing bodies and having transfer sections; a voltage supply for generating a transfer voltage; a mounting member for bringing the transfer sections into contact with the image bearing bodies when the transfer unit is installed at an appropriate position within apparatus body and into non-contact with the image bearing bodies when the transfer unit is installed at an inappropriate position within the apparatus body; and detection devices for applying the transfer voltage to the transfer sections to detect whether the transfer unit is in contact with the image bearing bodies.

The transfer voltage is applied to the transfer sections to determine whether the transfer unit is connected to the image carries so that it is possible to check whether the transfer unit is installed in the apparatus body. In addition, it is unnecessary to provide a sensor to check whether the operation of the mounting member is completed so that not only the structure of the image forming apparatus is simplified but also the manufacturing cost is reduced.

BRIEF DESCRIPTION OF THE DRAWINGS

FIG. 11 is a list showing the state of a memory for the printer;

FIG. 18 is a list of the state of a memory for the second printer.

DESCRIPTION OF THE PREFERRED EMBODIMENT

Figure 1:
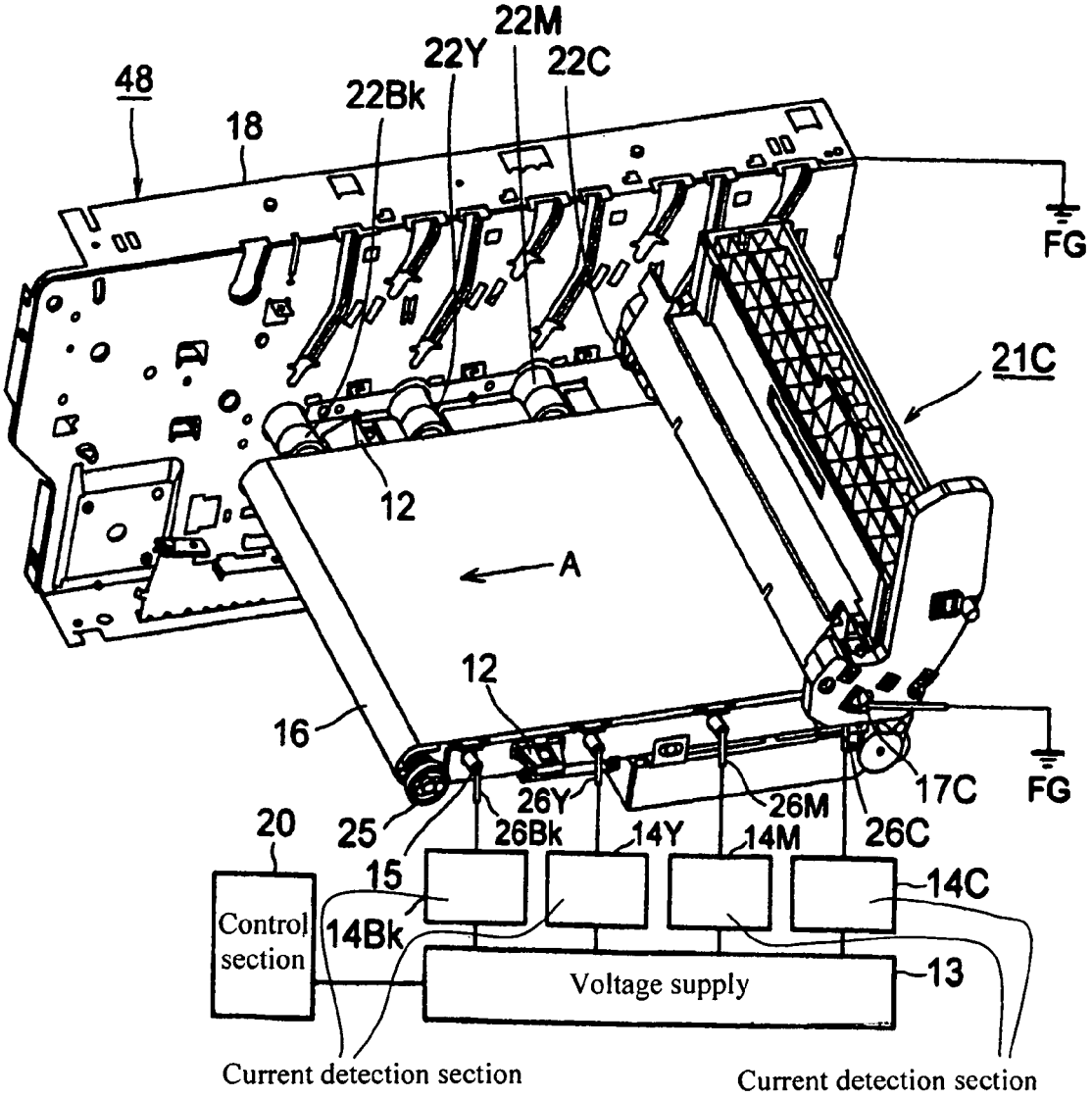
FIG. 1 is a perspective view of a printer according to the first embodiment of the invention.
Figure 2:
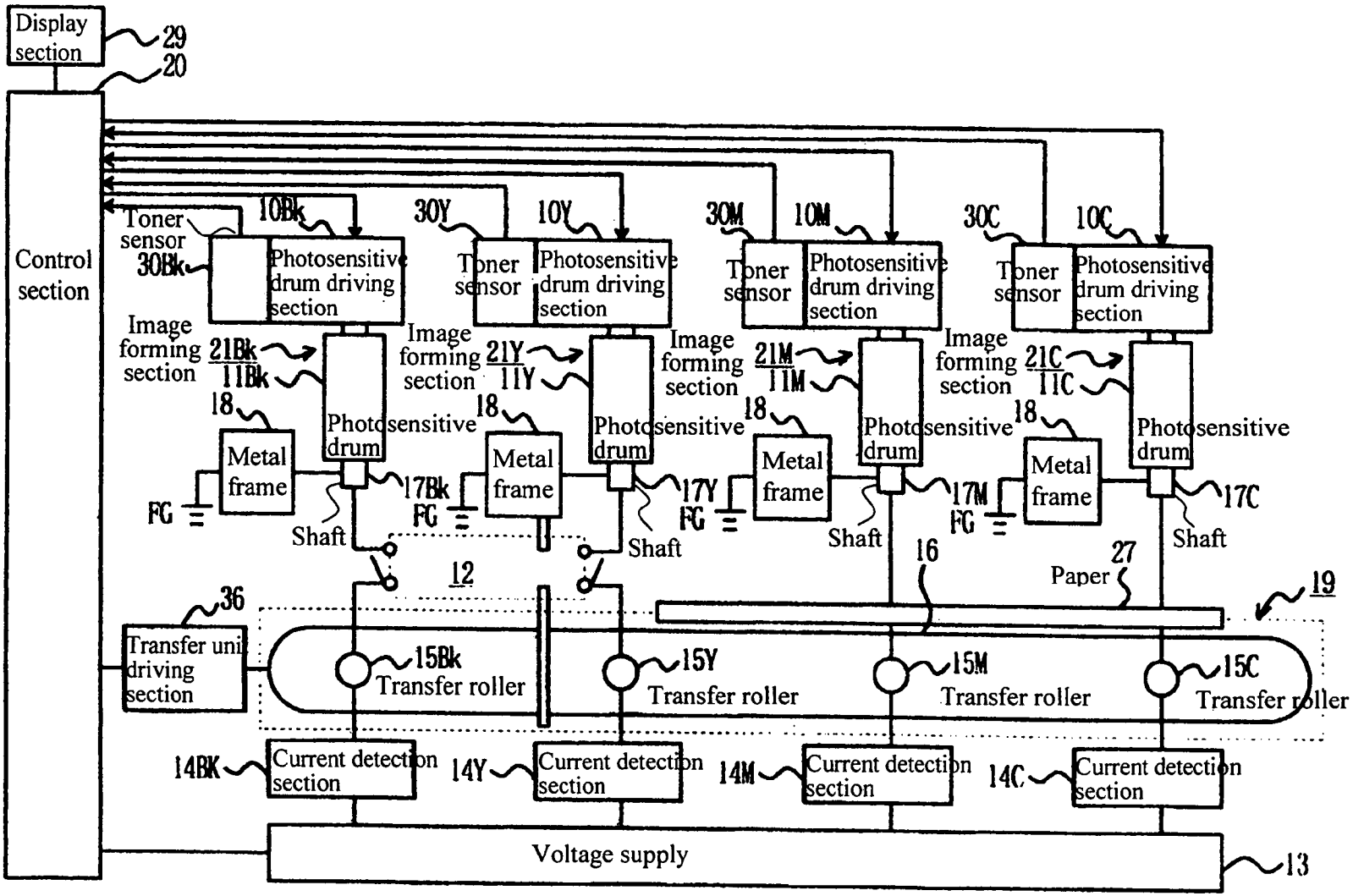
FIG. 2 is a block diagram of a control section of the printer.

Embodiments of the invention will now be described with reference to the accompanying drawings, wherein the image forming apparatus is an electrophotographic color printer that forms a color image by superimposing four color toner images.

In FIGS. 1–7, black, yellow, magenta, and cyan image forming sections (developing units) 21Bk, 21Y, 21M, and 21C, and an exposure units or recording heads 28Bk, 28Y, 28M, and 28C, and respective transfer rollers 15Bk, 15Y, 15M, and 15C are arranged along a transport member or transfer belt 16 in the running direction (arrow A) from the downstream to the upstream. Alternatively, they may be arranged from the upstream to the downstream.

The transfer rollers 15Bl, 15Y, 15M, and 15C, and the transfer belt 16 constitute a transfer unit 19. The transfer unit 19 is opposed to image bearing bodies or photosensitive drums 11Bk, 11Y, 11M, and 11C of the respective image forming sections 21Bk, 21Y, 21M, and 21C. It is mounted in place in a body 48 of the printer by operating a mounting member 12 (FIGS. 1 and 5) such that the respective photosensitive drums 11Bk, 11Y, 11M, and 11C come into contact with the transfer rollers 15Bk, 15Y, 15M, and 15C. If it is not fully mounted in place in the body 48, the respective photosensitive drums 11Bk, 11Y, 11M, and 11C do not come into contact with the transfer rollers 15Bk, 15Y, 15M, and 15C.

Similarly, the respective image forming sections 21Bk, 21Y, 21M, and 21C are installed in the body 48 by fitting between a pair of support members or metal frames 18. A display section 29 has a lamp or screen for displaying the state of the printer.

Figure 3:
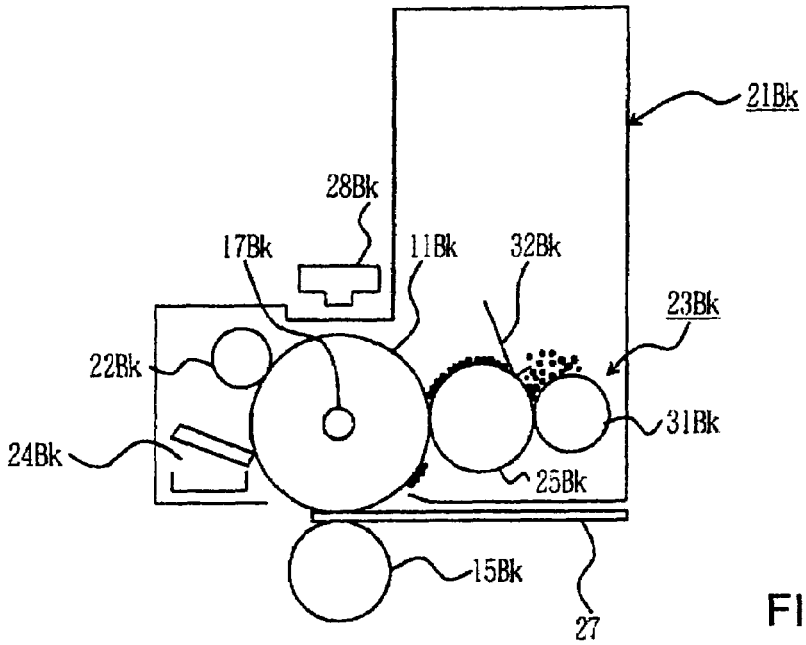
FIG. 3 is a side view of a black image forming section of the printer.

Since the image forming sections 21Bk, 21Y, 21M, and 21C have the same structure, only the image forming section 21Bk will be described with reference to FIG. 3. The image forming section 21Bk includes the photosensitive drum 11Bk rotatably disposed therein, a charging roller 22Bk rotatably disposed and opposed to the photosensitive drum 11Bk, a developing unit 23Bk opposed to the photosensitive drum 11Bk, and a cleaning unit 24Bk opposed to the photosensitive drum 11Bk. The developing unit 23Bk includes a developing roller 25Bk rotatably disposed therein, a developer supply roller 31Bk rotatably disposed in contact with the developing roller 25Bk, and a developing blade 32Bk disposed in abutment with the developing roller 25Bk.

A shaft 17Bk, 17Y, 17M, or 17C of each photosensitive drum 11Bk, 11Y, 11M, or 11C is connected to a photosensitive drum driving section 10Bk, 10Y, 10M, or 10C that includes a motor. A control section 20 energizes the photosensitive drum driving section 10Bk, 10Y, 10M, or 10C to rotate the shaft 17Bk, 17Y, 17M, or 17C and, thus, the photosensitive drum 11Bk, 11Y, 11M, or 11C. Each image forming section 21Bk, 21Y, 21M, or 21C contains a developer of each color or toner and a stirrer (not shown) for stirring the toner. A toner sensor 30Bk, 30Y, 30M, or 30C is disposed outside the image forming section 21Bk, 21Y, 21M, or 21C to detect the toner, sending a sensor output to the control section 20.

The stirrers are driven by motors (not shown) disposed outside the respective image forming sections 21Bk, 21Y, 21M, and 21C. The motors are driven at a constant speed, and the stirrers are rotated in step with the driving of the motors between the lower and upper dead points but, when they reach the upper dead points, they fall by their own weight. Consequently, when the amount of toner within the image forming section 21Bk, 21Y, 21M, or 21C is small, the stirrer stays near the lower dead point for a long time but, when the amount of toner is large, the stirrer stays near the lower dead point for a short time. Thus, based on the sensor output (on/off) of the toner sensor 30bk, 30Y, 30M, or 30C, the control section 20 calculates the time in which the stirrer stays near the lower dead point to detect a TONER LOW, that is, lack of the toner within each image forming section 21Bk, 21Y, 21M, or 21C.

Where any image forming section 21Bk, 21Y, 21M, and/or 21C is not installed, the sensor output from the toner sensor 30Bk, 30Y, 30M, or 30C becomes a constant level (ON or OFF level). As a result, if the sensor output from the toner sensor 30Bk, 30Y, 30M, or 30C is unchanged for a predetermined time, it is understood that the image forming section 21Bk, 21Y, 21M, or 21C is not installed.

When the control section 20 energizes a transfer unit driving section 36 including a motor, the transfer belt 16 is run in sync with the photosensitive drum 11Bk, 11Y, 11M, and 11C so that the running speed of the transfer belt 16 becomes equal to the circumferential speed of each photosensitive drum 11Bk, 11Y, 11M, and 11C. A recording medium or paper 27 is transported in step with the running of the transfer belt 16 so that the transporting speed is equal to the running speed.

The charging roller 22Bk, 22Y, 22M, or 22C charges uniformly the surface of the photosensitive drum 11Bk, 11Y, 11M, or 11C and the recording head 28Bk, 28Y, 28M, or 28C exposes the surface of the photosensitive drum 11Bk, 11Y, 11M, or 11C to form an electrostatic latent image. Then, the developing unit 23Bk, 23Y, 23M or 23C makes the toner adhere to the electrostatic latent image to form a toner image, which is transferred to the paper 27 by the transfer unit 19.

In this way, the respective image forming sections 21Bk, 21Y, 21M, and 21C form the toner images of respective colors, which are superimposed by transfer to the paper 27 to form a color toner image. The paper 27 is sent to a fixing unit (not shown) in which the color toner image is fixed to form a color image.

Where a toner is added to the image forming section 21Bk, 21Y, 21M, or 21C, or the image forming section 21Bk, 21Y, 21M, or 21*c* is replaced, or the transfer belt 16 is replaced, the image forming section 21Bk, 21Y, 21M, or 21C, or the transfer unit 19 is removed and, then, installed again. In order to avoid printing with no image forming section 21Bk, 21Y, 21M, or 21C or no transfer unit 19 installed, contact members 26Bk, 26Y, 26M, and 26C are disposed in the body 48. When The image forming sections 21Bk, 21Y, 21M, and 21C and the transfer unit 19 are installed in the body 48, the respective transfer rollers 15Bk, 15Y, 15M, and 15C come into contact with the contact members 26Bk, 26Y, 26M, and 26C so that the transfer voltage generated by the voltage supply 13 is applied to the respective transfer rollers 15Bk, 15Y, 15M, and 15C for printing. The transfer unit 19 is installed in the body 48 by operating the mounting member 12.

If printing is started with the transfer unit 19 installed imperfectly, it is impossible to run the transfer belt 16 appropriately, causing poor transportation of the paper 27. If the transfer unit 19 is installed imperfectly so that the transfer rollers 15Bk, 15Y, 15M, and 15C are not in full contact with the contact members 26Bk, 26Y, 26M, and 26C, the transfer unit 19 fails to transfer the toner image.

If the transfer unit 19 is installed imperfectly so that the photosensitive drums 11Bk, 11Y, 11M, and 11C do not rotate in sync with the transfer belt 16, it is impossible to transfer accurately the toner image to the paper 27. If a high voltage is applied to the photosensitive drum 11Bk, 11Y, 11M, or 11C which are stopped due to the imperfect installation of the photosensitive drum 11Bk, 11Y, 11M, or 11C, the photosensitive drum 11Bk, 11Y, 11M, or 11C is damaged due to the local high voltage.

Figure 4:
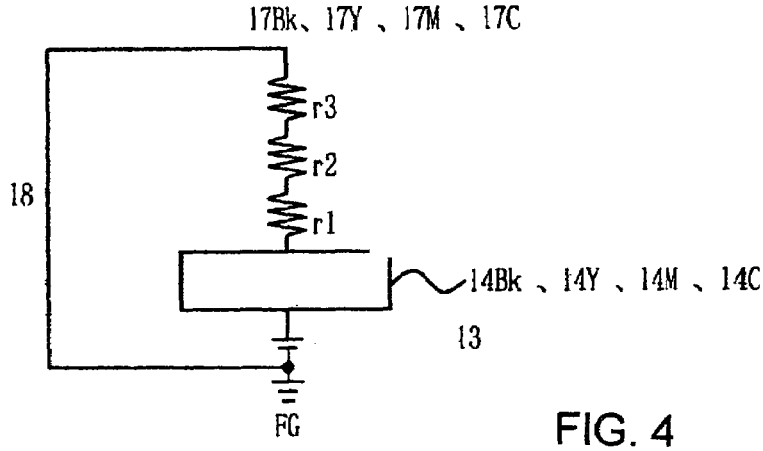
FIG. 4 is an equivalent circuit diagram showing the path of a transfer current for the printer.

Thus, current detecting sections 14Bk, 14Y, 14M, and 14C are provided between the voltage supply 13 and the respective transfer rollers 15Bk, 15Y, 15M, and 15C to detect the transfer currents supplied by the voltage supply 13 to the respective transfer rollers 15Bk, 15Y, 15M, and 15C. As shown in FIG. 4, when the transfer voltage is applied to the respective transfer rollers 15Bk, 15Y, 15M, and 15C, the transfer currents are conducted from the voltage supply 13 to the ground FG via the respective current detection sections 14Bk, 14Y, 14M, and 14C, contact members 26Bk, 26Y, 26M, and 26C, the transfer rollers 15Bk, 15Y, 15M, and 15C (r1), the transfer belt 16 (r2), the paper 27, the photosensitive drums 11Bk, 11Y, 11M, and 11C (r3), the photosensitive drum shafts 117Bk, 17Y, 17M, and 17C, and the metal frame 18.

Consequently, based on the transfer currents detected by the current detecting sections 14Bk, 14Y, 14M, and 14C, it is possible to determine whether the transfer unit 19 and the imaging forming sections 21Bk, 21Y, 21M, and 21C are installed in the body 48 and whether the operation of the mounting member 12 is completed. The installation state determining device (not shown) of the control section 20 determines the installation state and reads the respective transfer currents detected by the current detecting sections 14Bk, 14Y, 14M, and 14C as parameters for determining the installation states to determine whether the transfer units 19 are installed based on the respective transfer currents.

Figure 5:
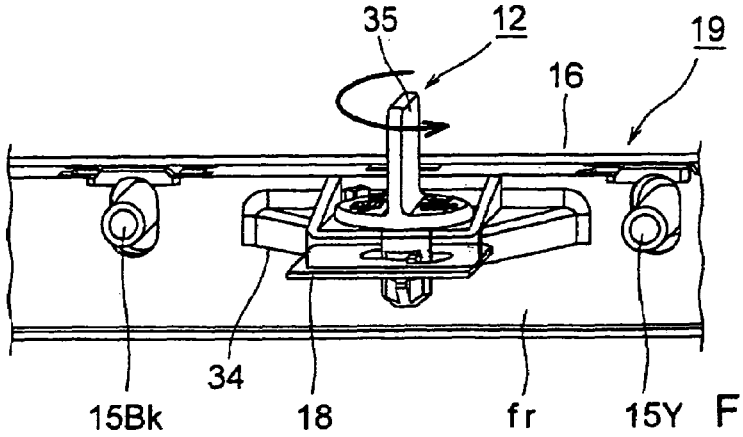
FIG. 5 is a perspective view of a mounting member for the printer.

As shown in FIG. 5, the mounting member 12 is disposed outside an edge of the transfer belt 16 between the image forming sections 21Bk and 21Y for rotation with respect to a bracket 34 attached to a frame (fr) of the transfer unit 19. Where the operation of the mounting member 12 is completed and the transfer unit 19 is fully installed in the body, the transfer unit 19 is secured to the metal frame 18 and an interfering plate 35 of the mounting member 12 is disposed parallel to the respective transfer rollers 15Bk, 15Y, 15M, and 15C.

Figure 6:
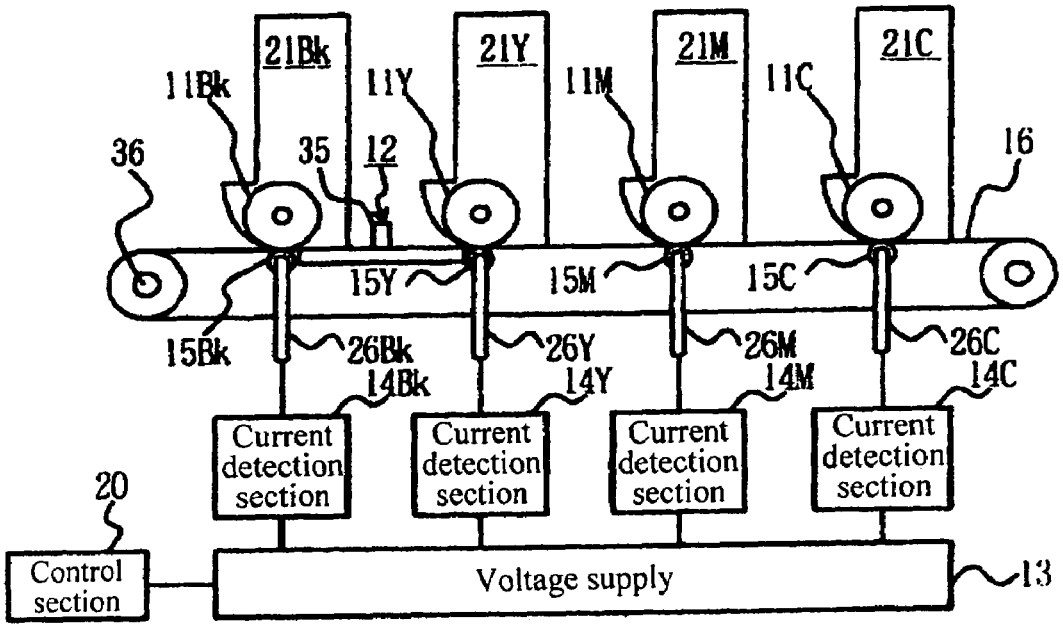
FIG. 6 is a side view of the printer in the first state.

As shown in FIG. 6, under such conditions as described above, the interference plate 35 does not interfere with the bottoms of the respective image forming sections 21Bk, 21Y, 21M, and 21C so that the respective image forming sections 21Bk, 21Y, 21M, and 21C are placed in lower operation positions, bringing the photosensitive drums 11Bk, 11Y, 11M, and 11C into contact with the transfer belt 16 to conduct the respective transfer currents.

Figure 7:
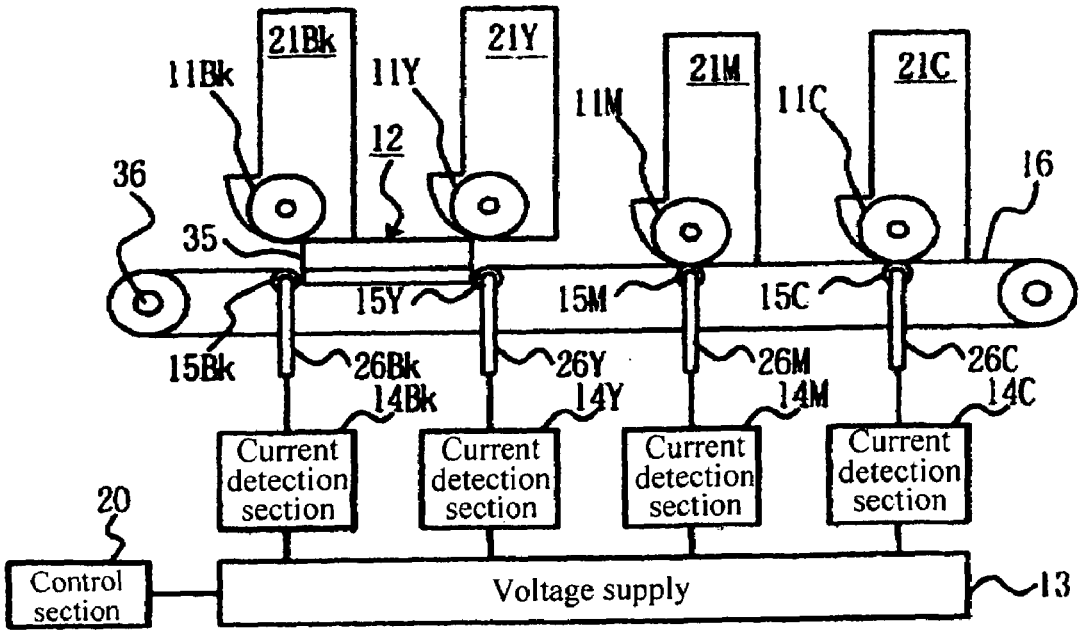
FIG. 7 is a side view of the printer in the second state.

As shown in FIG. 7, where the operation of the mounting member 12 is not completed and the transfer unit 19 is not fully installed in the body 48 and not secured to the metal frame 18, the interference plate 35 is disposed at right angles with the respective transfer rollers 15Bk, 15Y, 15M, and 15C. Consequently, the interference plate 35 interferes with the bottoms of the image forming sections 21Bk and 21Y so that the image forming sections 21Bk and 21Y are placed at upper retreated position, with the result that the photosensitive drums 11Bk and 11Y are not in contact with the transfer belt 16, thus cutting off the transfer currents.

Since the transfer currents flow when the operation of the mounting member 12 is completed but it does not flow when the operation of the mounting member 12 is not completed, it is possible to check whether the operation of the mounting member 12 is completed based on the respective transfer currents.

Figure 10:
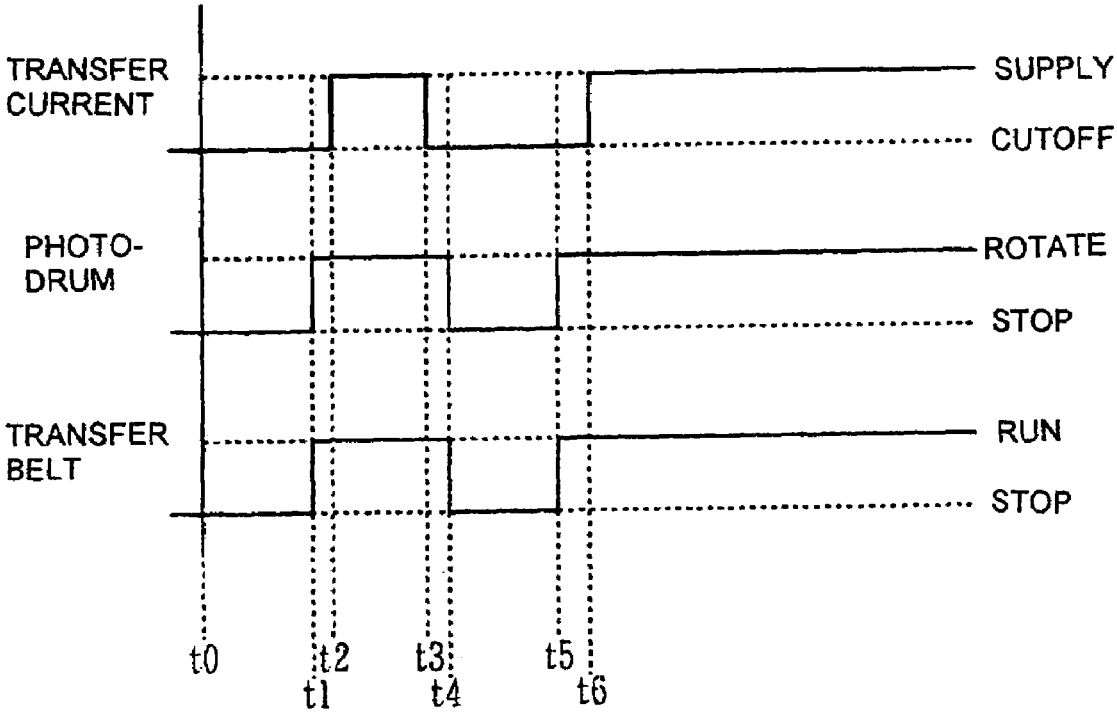
FIG. 10 is a time chart showing the operation of the printer.

In FIG. 10, when the printer is switched on at a time t0, a safety device of the installation state determining device performs a safety process and starts rotation of the photosensitive drums 11Bk, 11Y, 11M, and 11C and running of the transfer belt 16 at a time t1 so as to prevent a local damage to the photosensitive drums 11Bk, 11Y, 11M, and 11C by the transfer currents. Then, a detection device of the installation state determining device performs a detection process and sends an instruction to the voltage supply 13 at a time t2 to supply the respective transfer rollers 15Bk, 15Y, 15M, and 15C with voltages predetermined for the respective colors and the respective transfer rollers, and the current detection sections 14Bk, 14Y, 14M, and 14C detect the transfer currents of the respective colors.

The determination device of the installation state determining device performs a determination process and reads the detection results or transfer currents of the respective colors from the current detection sections 14Bk, 14Y, 14M, and 14C to determine whether the black transfer current is below 0.1 μA+α.

If the black transfer current is below 0.1 μA+α, the determination device saves UNDETECTABLE of the transfer current in a memory in the control section 20. If the black transfer current is above 0.1 μA+α, the determination device determines that the transfer unit 19 is installed and saves in the memory DETECTABLE of the transfer current and the installation of the transfer unit 19. α is a margin set by considering the precisions of the respective current detecting sections 14Bk, 14Y, 14M, and 14C.

Similarly, the determination device determines whether the transfer current is below 0.1 μA+α for each of yellow, magenta, and cyan. If the transfer current is below 0.1 μA+α, the determination device saves in the memory UNDETECATBLE and, if the transfer current is above 0.1 μA+α, it determines that the transfer unit 19 is installed and stores in the memory not only DETECTABLE but also the installation of the transfer unit 19. In this way, if one of the transfer currents is above 0.1 μA+α, the determination device determines that the transfer unit 19 is installed and stores in the memory the installation of the transfer unit 19.

Then, the detection device terminates the voltage application and current supply to the respective transfer rollers 15Bk, 15Y, 15M, and 15C at a time t3.

The safety device stops the rotation of the photosensitive drums 11Bk, 11Y, 11M, and 11C and the running of the transfer belt 16 at a time t4. The rotation of the photosensitive drums 11Bk, 11Y, 11M, and 11C and the running of the transfer belt 16 are continued in this way in a period between t1 and t4 so that the location of each photosensitive drum 11Bk, 11Y, 11M, or 11C through which the transfer current flows always changes, thereby preventing a local damage to the photosensitive drum 11Bk, 11Y, 11M, or 11C.

Based on the transfer currents of the respective colors, the determination device determines whether the respective image forming sections 21Bk, 21Y, 21M, and 21C are installed and whether the operation of the mounting member 12 is completed. Where the transfer current of a predetermined color flows, it is determined that the image forming section of the corresponding color is installed. In addition, where the transfer current for at least one of black and yellow flows, it is determined that the operation of the mounting member 12 is completed.

However, if neither black nor yellow transfer current flows, it is possible that the transfer unit 19 is not installed, either black or yellow image forming section is not installed, and/or that the operation of the mounting member 12 is not completed. In addition, if the transfer current of either magenta or cyan does not flow, it is determined that the transfer unit 19 is not installed and/or that the image forming section of either magenta or cyan is not installed.

As shown in FIG. 11, if the respective transfer currents of yellow, magenta, and cyan flow but no black transfer current flows, the determination device determines that the transfer unit 19 is installed and that the operation of the mounting member 12 is completed. In addition, since the respective transfer currents for yellow, magenta, and cyan flow, it determines that the transfer unit 19 and the image forming sections 21Y, 21M, and 21C are installed but the image forming section 21Bk is not installed.

If no transfer currents for black, yellow, magenta, and cyan flow, it is possible that the transfer unit 19 is not installed, no image forming sections 21Bk, 21Y, 21M, and 21C are installed, and that the operation of the mounting member 12 is not completed. Consequently, the determination device cannot make determination based on only the transfer currents of the respective colors and cannot determine the installation states of the transfer unit 19 and the image forming sections 21Bk, 21Y, 21M, and 21C and the operation sate of the mounting member 12.

Thus, the determination device employs outputs of the toner sensors 30Bk, 30Y, 30M, and 30C as a determination parameter in addition to the transfer currents to determine the installation states of the transfer unit 19 and the image forming sections 21Bk, 21Y, 21M, and 21C and the operation state of the mounting member 12.

In FIG. 11, x stands for UNDETECTABLE or the transfer current is below 0.1 μA+α; O DETECTACLE or the transfer current is above 0.1 μA+α; UNINST and INSTAL means that the transfer unit 19, or the image forming section 21Bk, 21Y, 21M, or 21C is not installed and installed, respectively; and INCOMP and COMPL means that the operation of the mounting member 12 is not complete and complete, respectively.

The determination device determines whether the installation of the transfer unit 19 is stored in the memory. If the installation is not saved, it reads the sensor outputs of the respective toner sensors 30Bk, 30Y, 30M, and 30C to determine whether the toner sensor for at least one color detects the toner. If the toner sensor for at least one color detects the toner, it determines that the transfer unit 19 is not installed and stores in the memory that the transfer unit 19 is not installed. In this case, it can determine that the image forming section for the color is installed.

If all of the toner sensors 30Bk, 30Y, 30M, and 30C do not detect the toner, it determines that none of the image forming sections 21Bk, 21Y, 21M, and 21C are installed and stores in the memory that none of them are installed. Then, it determines whether UNDETECTABLE of the black and yellow transfer currents is stored in the memory. If UNDETACTABLE is stored in the memory, it determines whether UNINSTALLATION of the black and yellow image forming sections is stored in the memory. If UNINSTALLATION is not stored in the memory, it determines that the operation of the mounting member 12 is not completed and stores it in the memory.

If INSTALLATION of the transfer unit 19 is stored in the memory, it determines whether there is an image forming section not installed and whether UNINSTALLATION of the unit is stored since the operation of the mounting member 12 is not completed. If UNINSTALLATION of the unit is not stored, it determines that the transfer unit 19 and the respective image forming sections 21Bk, 21Y, 21M, and 21C are installed and the operation of the mounting member 12 is completed and the installation state determining device stops the process.

If the transfer unit 19 is not installed, at least one of the image forming sections 21Bk, 21Y, 21M, and 21C is not installed, or the operation of the mounting member 12 is not completed, the display device of the installation state determining device performs a display process and, at a time t5, presents on a display 29 the determination result indicating that the transfer unit 19 is not installed, at least one of the image forming sections 21Bk, 21Y, 21M, and 21C is not installed, or the operation of the mounting member 12 is not completed.

The printer is provided with a cover (not shown) so that the image forming section 21Bk, 21Y, 21M, or 21C, or the transfer unit 19 can be removed from the printer and a cover sensor (not shown) to detect the open/close of the cover. The installation state determining device reads the sensor output of the cover sensor to determine that the cover is closed after opening. If the cover is closed after opening, it determines that the image forming section 21Bk, 21Y, 21M, or 21C, or the transfer unit 19 is removed from the printer and installed again and starts the process again.

In this way, if it determines that the transfer unit 19 and the image forming sections 21Bk, 21Y, 21M, and 21C are installed and the operation of the mounting member 12 is completed, a printing device (not shown) of the control section 20 performs a printing process and, at a time t5, make a printing preparation, starting the rotation of the photosensitive drums 11Bk, 11Y, 11M, and 11C and the running of the transfer belt 16 and, at a time t6, applies a transfer voltage to the transfer rollers 15Bk, 15Y, 15M, and 15C for supplying transfer currents for the respective colors.

In the printing preparation, a new/old determination device of the control section 20 performs a new/old determination process by which consumption articles for the image forming sections 21Bk, 21Y, 21M, and 21C are determined to be new or old. A management information retrieval device of the control section 20 performs a management information retrieval process by which it accesses the memory or ROM (not shown) provided in the transfer unit 19 and the image forming sections 21Bk, 21Y, 21M, and 21C to read the management information about the transfer unit 19 and the image forming sections 21Bk, 21Y, 21M, and 21C (for example, the resistance values of the transfer rollers 15Bk, 15Y, 15M, and 15C, and the amounts of toner used in the image forming sections 21Bk, 21Y, 21M, and 21C). Based on the determination result of the consumption articles and the management information, the printing device makes corrections to the printing conditions (transfer voltage, transfer current, developing voltage, etc.).

According to the invention, where the mounting member 12 is not fully fixed, the photosensitive drums 11Bk, 11Y, 11M, and 11C are spaced from the transfer belt 16 by the mounting member 12 to cut off the transfer current supplied by the voltage supply 13. Thus, it is possible to simultaneously determine the installation states of the transfer unit 19 and the image forming sections 21Bk, 21Y, 21M, and 21C and the operational state of the mounting member 12 without using an expensive special sensor. Based on the transfer currents detected by the current detecting sections 14Bk, 14Y, 14M, and 14C, it is possible to determine not only the installation of the transfer unit 19 and the image forming sections 21Bk, 21Y, 21M, and 21C but also the completion of the operation of the mounting member 12.

Since whether the operation of the mounting member 12 is completed is determined based on the transfer currents, it is not necessary to provide a sensor in each mounting member 12, thus making the printer simpler and the manufacturing cost lower. Printing is not started with the transfer unit 19 not fully installed, the transfer belt 16 is run properly and poor transportation of the paper 27 is prevented. Where the transfer unit 19 is not fully installed, bringing the contact members 26Bk, 26Y, 26M, and 26C into poor contact with the transfer rollers 15Bk, 15Y, 15M, and 15C, printing is not started.

Since whether the operation of the mounting member 12 is completed is determined, it is prevented that poor installation of the transfer unit 19 makes the rotation of the photosensitive drums 11Bk, 11Y, 11M, and 11C out of sync with the running of the transfer belt 16 or that a high charging voltage is applied to the stopped photosensitive drums 11Bk, 11Y, 11M, and 11C. After the transfer unit 19 and the image forming sections 21Bk, 21Y, 21M, and 21C are installed and the operation of the mounting member 12 is completed, the new/old determination of consumption articles is made and ROM is accessed to read the management information, it is possible to make appropriate corrections to the consumption articles and the printing conditions. By using the sensor outputs of the toner sensors 30Bk, 30Y, 30M, and 30C, it is possible to combine the sensor outputs and the transfer voltage to determine in detail whether the transfer unit 19 and the image forming sections 21Bk, 21Y, 21M, and 21C are installed and whether the operation of the mounting member 12 is completed.

The new/old determination circuit will be described below. All new/old determination circuits for the image forming sections 21Bk, 21Y, 21M, and 21C are the same in structure and, therefore, only that of the black image forming section 21Bk will be described.

Figure 12:
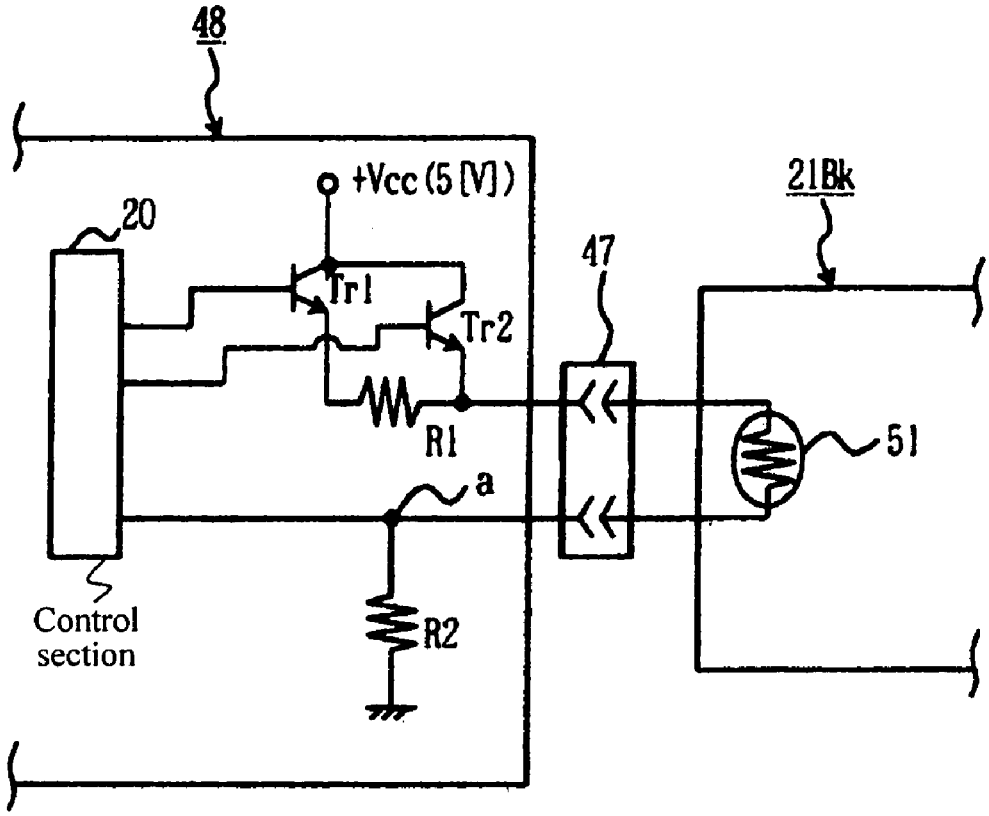
FIG. 12 is a circuit diagram of a section for determining new/old supplies.

In FIG. 12, the black image forming section 21Bk includes a fuse 51, which is connected to the circuit within the printer body 48 via a connector 47. The collector of the transistor Tr1 is connected to a collector voltage source 5 Vcc, the emitter to an end of the fuse 51 via a resistor R1 and the connector 47, and the base to the control section 20. The collector of the transistor Tr2 is connected to the voltage source 5 Vcc, the emitter to the one end of the fuse 51 via the connector 47, and the base to the control section 20. The other end of the fuse 51 is connected to the control section 20 via the connector 47 and branched at a point (a) to the ground via a resistor R2.

The new/old determining device performs a new/old determining process, turning on the transistor Tr1 to supply electric current to the fuse 51 and reads a voltage at the point (a) divided by the fuse 51 and the resistor R2. If the divided voltage is above 2 V, it determines that the fuse 51 is not cut off and that the image forming section 21Bk is new. If the divided voltage is blow 2 V or actually almost equal to 0 V, it determines that the fuse 51 is cut off and the image forming section 21Bk is old. If it is determined that the image forming section 21Bk is old, a fuse cut-off device (not shown) of the control section 20 turns on the transistor Tr2 to cut off the fuse 51. In this way, it is possible to determine whether the image forming section 21Bk is new or old.

Figure 8:
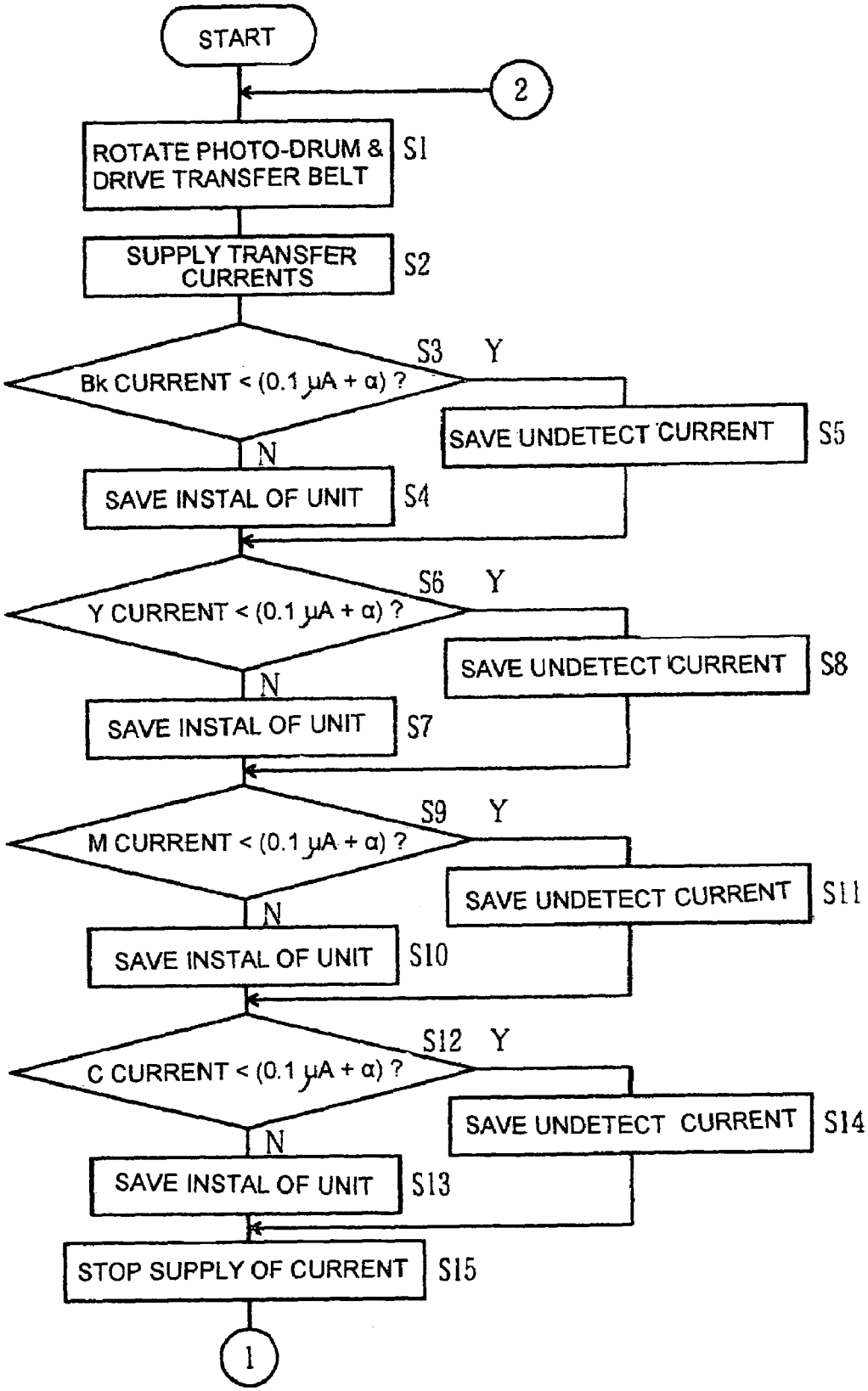
FIG. 8 is the first flow chart of a process for determining the mounting state.
Figure 9:
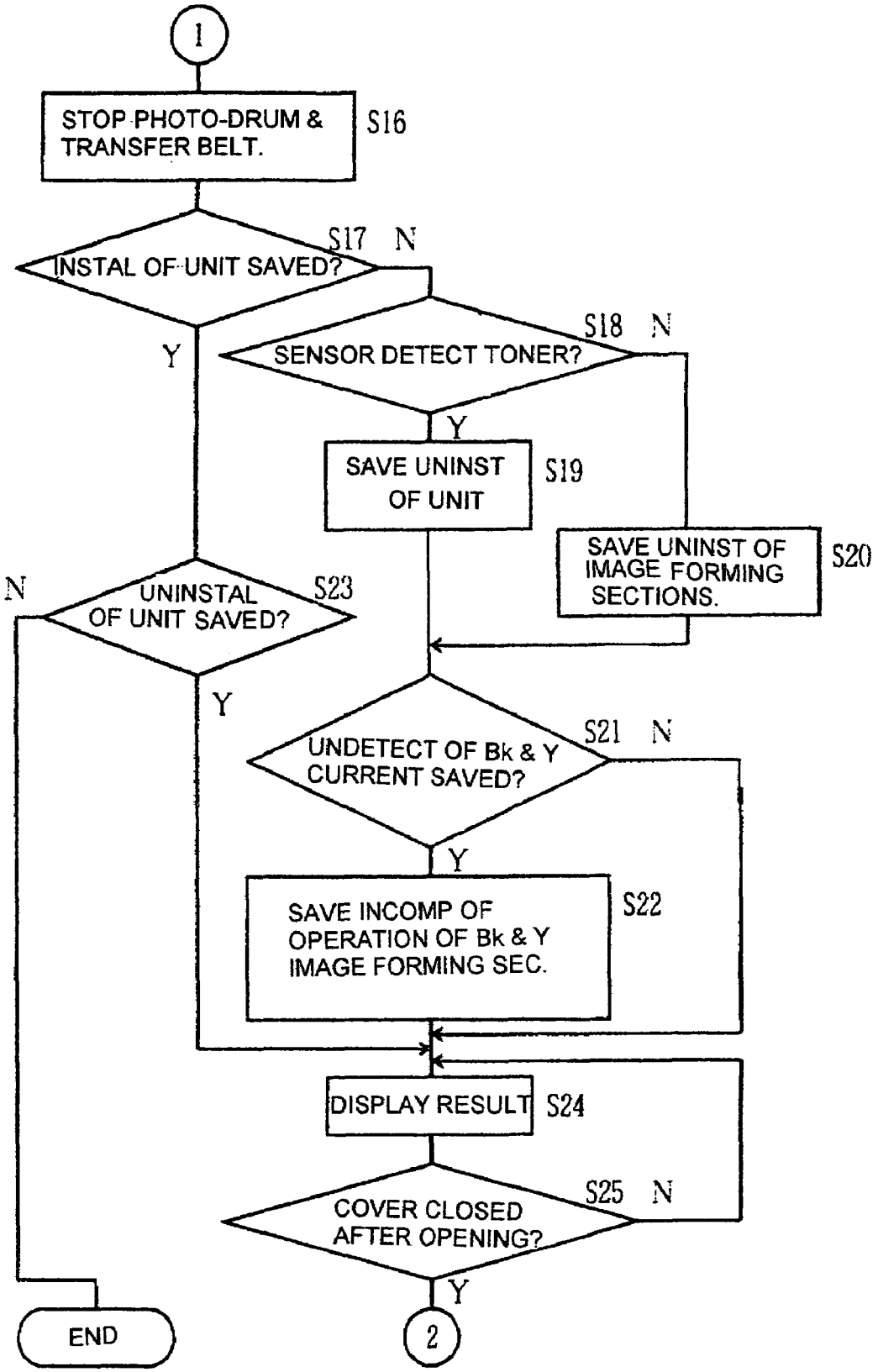
FIG. 9 is the second flow chart of the process for determining the mounting state.

The operation will now be described with respect to the flow charts in FIGS. 8 and 9.

At a step S1, the rotation of the photosensitive drums 11Bk, 11Y, 11M, and 11C and the running of the transfer belt 16 are started.

At a step S2, transfer currents of the respective colors are supplied.

At a step S3, whether the black transfer current is below 0.1 μA+α is determined. If it is below 0.1 μA+α, the process goes to a step S5 and, otherwise, to a step S4.

At the step S4, INSTALLATION of the transfer unit 19 is saved or stored in the memory.

At the step S5, UNDETACTABLE of the transfer current is saved or stored in the memory.

At a step S6, whether the yellow transfer current is below 0.1 μA+α is determined. If it is below 0.1 μA+α, the process goes to a step 8 and, otherwise, to a step S7.

At the step S7, INSTALLATION of the transfer unit 19 is saved.

At the step S8, UNDETECTABLE of the transfer current is saved.

At a step S9, whether the magenta transfer current is below 0.1 μA+α is determined. If it is below 0.1 μA+α, the process goes to a step S11 and, otherwise, to a step 10.

At the step S10, INSTALLATION of the transfer unit 19 is saved.

At the step S11, UNDETECTABLE of the transfer current is saved.

At a step S12, whether the cyan transfer current is below 0.1 μA+α is determined. If it is below 0.1 μA+α, the process goes to a step S14 and, otherwise, to a step s13.

At the step S13, INSTALLATION of the transfer unit 19 is saved.

At the step S14, UNDETECTABLE of the transfer current is saved.

At a step S15, supply of the transfer currents for the respective colors is stopped.

At a step S16, the rotation of the photosensitive drums 11Bk, 11Y, 11M, and 11C and the running of the transfer belt 16 are stopped.

At a step S17, whether INSTALLATION of the transfer unit 19 is saved is determined. If it is saved, the process goes to a step S23 and, otherwise, to a step S18.

At the step S18, whether the toner sensor for at least one color detects the toner is determined. If it detects the toner, the process goes to a step S19 and, otherwise, to a step S20.

At the step S19, UNINSTALLATION of the transfer unit 19 is saved.

At the step S20, UNINSTALLATION's of all of the image forming sections 21Bk, 21Y, 21M, and 21C are saved.

At the step S21, whether Undetectable of the black and yellow transfer currents are saved is determined. If they are saved, the process goes to a step S22 and, otherwise, to a step S24.

At the step S22, if UNINSTALLATION's of the black and yellow image forming sections 21Bk and 21Y are not saved, IMCOMPLETION of the operation of the mounting member 12 is saved.

At the step S23, whether UNINSTALLATION of the unit is saved is determined. If it is saved, the process goes to a step S24 and, otherwise, to END.

At the step S24, the determination result is displayed.

At a step S25, whether the cover is closed after opening is determined. If it is closed after opening, the process returned to the step S1 and, otherwise, to the step S24.

In this embodiment, the single mounting member 12 raises the image forming sections 21Bk and 21Y. However, the number of mounting members 12 and the number of image forming sections raised are changeable.

Figure 13:
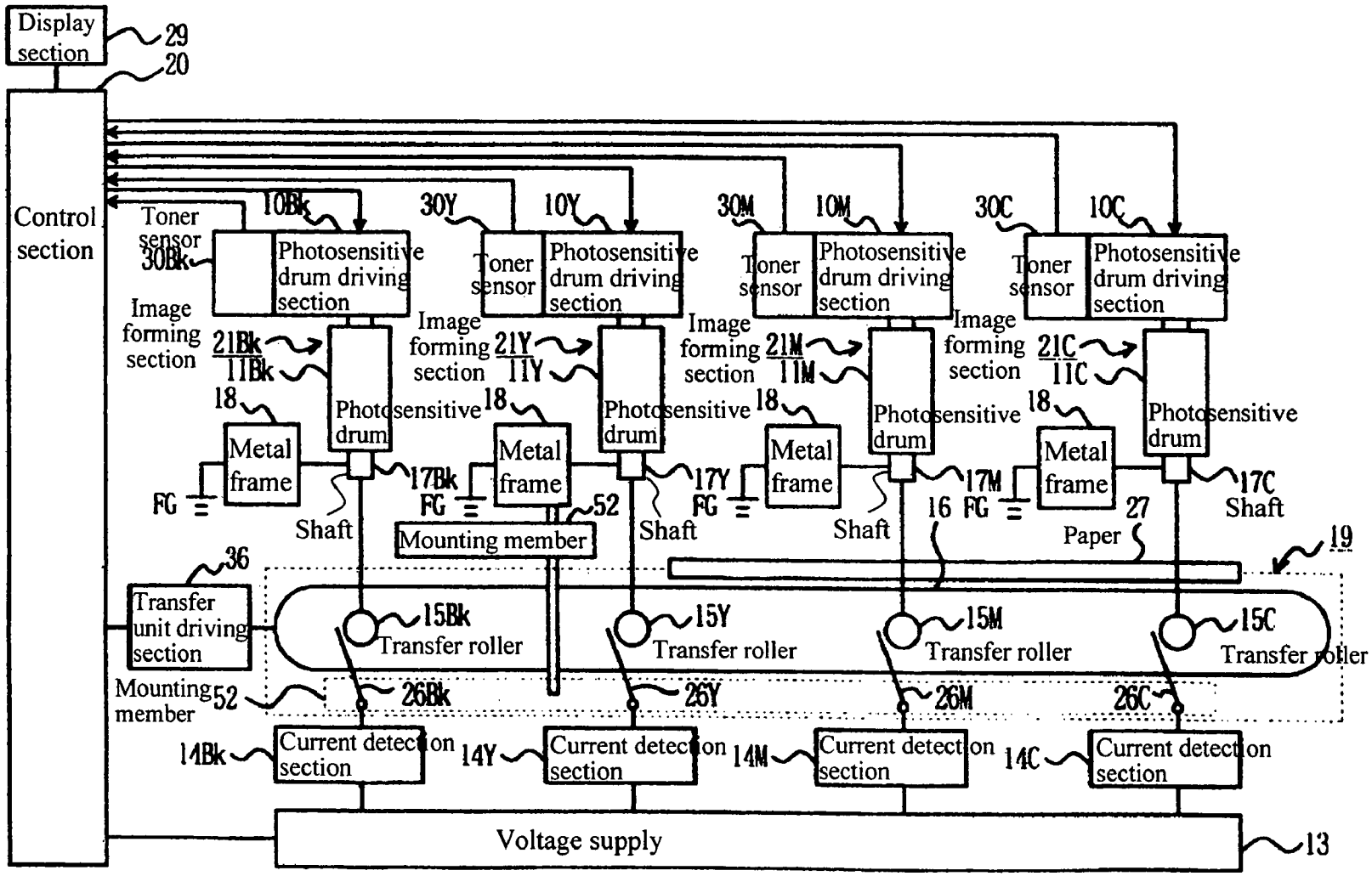
FIG. 13 is a block diagram of a control section of a second printer according to the second embodiment.
Figure 14:
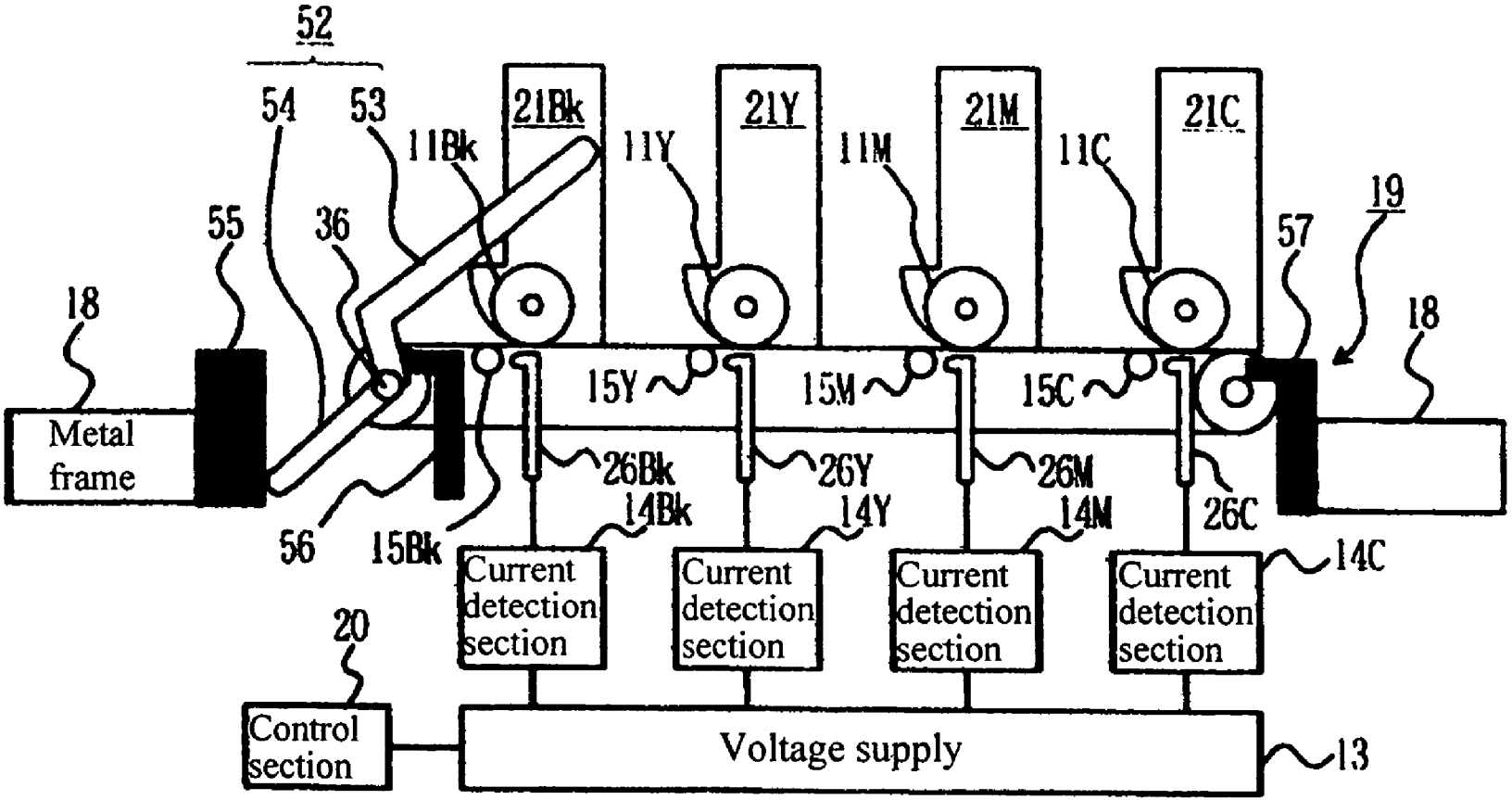
FIG. 14 is a side view of the second printer in the first state.

The second embodiment of the invention will be described below with respect to FIGS. 13–15. The same structures as those of the first embodiment are given the same reference numbers and their descriptions will be omitted.

The transfer unit 19 includes a mounting member 52 swingable with respect to the axis of the transfer unit driving section 36. The mounting member 52 has a lever-shaped form having a first or operation arm 53 extending toward an end of the axis and a second or driving arm 54 extending toward the other end of the axis. Engaging sections 55–57 are attached to the metal frame 18 at predetermined positions. In the figure, the metal frame 18 for the engaging section 56 is omitted for the purpose of simplicity.

By turning the mounting member 52 it is possible to secure the transfer unit 19 to the metal frame 18. As best shown in FIG. 14, when the mounting member 52 is tilted, the transfer unit 19 is brought to the uninstall position, releasing the engagement between the transfer unit 19 and the metal frame 18, making it possible to move the transfer unit 19 in the transporting direction of the paper 27. At this point, the respective transfer rollers 15Bk, 15Y, 15M, and 15C are not in contact with the contact members 26Bk, 25Y, 26M, and 26C provided on the body 48.

Figure 15:
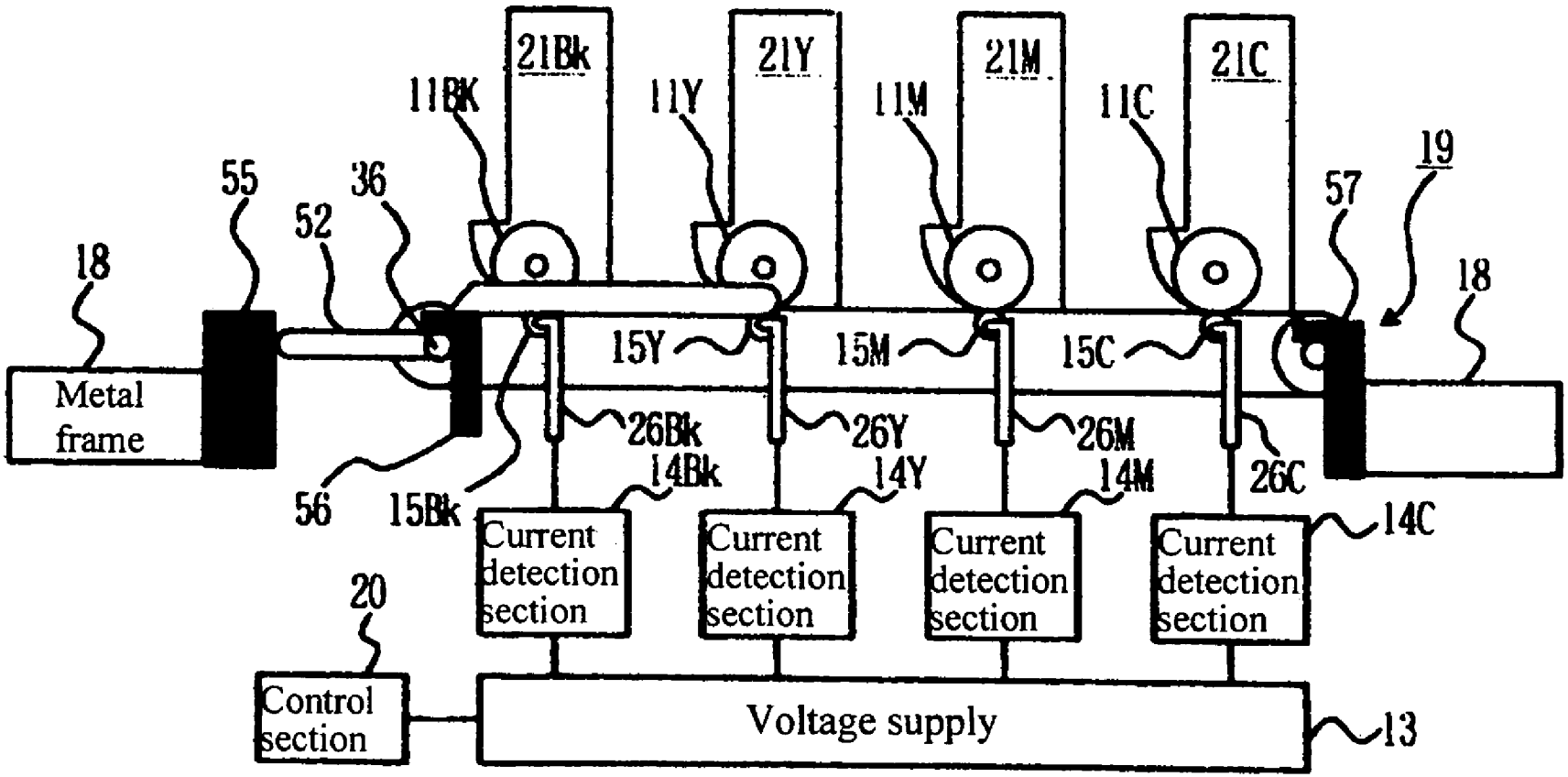
FIG. 15 is a side view of the second printer in the second state.

As shown in FIG. 15, the mounting member 52 is turned into a horizontal position, the transfer unit 19 is brought to an install position where it is engaged with and secured to the metal frame 18. At this point, the respective transfer rollers 15Bk, 15Y, 15M, and 15C are brought into contact with the contact members 26Bk, 26Y, 26M, and 26C so that the transfer voltage of the voltage supply 13 is applied to the respective transfer rollers 15Bk, 15Y, 15M, and 15C for printing.

How to determine the installation state by the control section 20 will be described with reference to FIG. 10.

At a time t0, when the printer is turn on, the safety device of the installation state determination device performs a safety process to prevent a local damage to the photosensitive drum 11Bk, 11Y, 11M, and/or 11C by the transfer current; i.e., at a time t1, the rotation of the photosensitive drums 11Bk, 11Y, 11M, and 11C and the running of the transfer belt 16 are started. Subsequently, the detection device of the installation state determining device performs a detection process; i.e., at a time t2, it instructs the voltage supply 13 to apply a voltage to the transfer roller 15Bk, 15Y, 15M, or 15C for each color and detect the transfer current for each color, thereby detecting whether the voltage supply 13 is connected to the transfer unit 19.

Then, the determination device of the installation state determining device performs a determination process by which it reads the transfer currents for the respective colors detected by the current detection sections 14Bk, 14Y, 14M, and 14C to determine whether the transfer current is below 0.1 $\mu A+\alpha$ for each of black, yellow, magenta, and cyan.

If the transfer current for black, yellow, magenta, or cyan is below 0.1 $\mu A+\alpha$, it saves or stored in the memory of the contact section 20 UNDETECTABLE of the transfer current and, when the transfer current is above 0.1 $\mu A+\alpha$, it determines that the transfer unit 19 is installed and saves both DETECTABLE of the transfer current and INSTALLATION of the transfer unit 19. Similarly to the first embodiment, if the transfer current is above 0.1 $\mu A+\alpha$ for at least one color, it determines that the transfer unit 19 is installed and saves INSTALLATION of the transfer unit 19 in the memory.

Subsequently, at a time t3, it stops the voltage application to the respective transfer rollers 15Bk, 15Y, 15M, and 15C to cut off the transfer currents.

At a time t4, the safety device stops the rotation of the photosensitive drums 11Bk, 11Y, 11M, and 11C and the running of the transfer belt 16. Then, based on the transfer currents of the respective colors, the determination device determines whether the respective image forming sections 21Bk, 21Y, 21M, and 21C are installed and whether the operation of the mounting member 52 is completed. To do this, it uses the sensor outputs from the toner sensors 30Bk, 30Y, 30M, and 30C in addition to the transfer currents to determine the installation states of the transfer unit 19 and the image forming sections 21Bk, 21Y, 21M, and 21C and the operational state of the mounting member 12.

That is, the determination device determines whether INSIALLATION of the transfer unit 19 is saved. If it is not saved, the determination device reads the outputs from the respective toner sensors 30Bk, 30Y, 30M, and 30C to determine whether the toner detector detects the toner for at least one color. If such a toner is detected, it determines that the transfer unit 19 is not installed and saves UNINSTALLATION of the transfer unit 19 in the memory. In this case, it can be determined that the image forming section is installed for the color of which the toner is detected by the toner sensor.

If none of the toner sensors 30Bk, 30Y, 30M, and 30C detect the toner, it determines whether UNDETECTABLE of the transfer current is saved for each of the colors. If UNDETECTABLE is saved for each of the colors, it determines that none of the image forming sections 21Bk, 21Y, 21M, and 21C are installed and saves UNINSTALLATION for each of the image forming sections 21Bk, 21Y, 21M, and 21C.

If UNDETECTABLE of the transfer current is saved for at east one color, it determines that not only the transfer unit 19 is not installed but also the operation of the mounting member 52 is not completed and saves them in the memory.

If the transfer unit 19 is installed, on the other hand, it determines whether any image forming section is not installed or the operation of the mounting member 12 is not completed so that UNINSTALLATION of the unit is saved. If UNINSTALLATION of the unit is not saved, it determines that the transfer unit 19 and the image forming sections 21Bk, 21Y, 21M, and 21C are installed and the operation of the mounting member 52 is completed, the installation state determining device terminates the process.

If the transfer unit 19 is not installed, at least one of the image forming sections 21Bk, 21Y, 21M, and 21C is not installed, or the operation of the mounting member 52 is not completed, the display device of the installation state determining device performs a display process for presenting on the display section 29 the determination result indicating that at a time t5, whether the transfer unit 19 is installed, at least one of the image forming sections 21Bk, 21Y, 21M, and 21C is not installed, or the operation of the mounting member 52 is not completed.

Then, the installation state determining device reads the sensor output from the cover sensor to determine that the cove is closed after opening. If the cover is closed after opening, it determines that the image forming section 21Bk, 21Y, 21M, or 21C, or the transfer unit 19 is removed from the printer and then installed again and restarts the process.

In FIG. 18, x stands for UNDETECTABLE of the transfer current or below 0.1 $\mu A+\alpha$ and O for DETECTABLE of the transfer current or above 0.1 $\mu A+\alpha$. UNINST indicates that the transfer unit 19 or the image forming section 21Bk, 21Y, 21M, or 21C is not installed; INSTAL that they are installed; INCOMP that the operation of the mounting member 52 is not completed; and COMPL that it is completed.

Where the transfer unit 19 is not fully installed and the operation of the mounting member 52 is not completed, the mounting member 52 moves the transfer unit 19 such that the transfer rollers 15Bk, 15Y, 15M, and 15C are separated from the contact members 26Bk, 26Y, 26M, and 26C, respectively, cutting off the transfer currents, making it impossible for the current detection sections 14Bk, 14Y, 14M, and 14C to detect them. Consequently, the determination device determines that not only the transfer unit 19 is not installed but also the operation of the mounting member 52 is not completed. The mounting member 52 has a lever shaped form so that when it is not operated, it does not affect the developing units 21Bk, 21Y, 21M, and 21C.

Where the transfer unit 19 is installed, as soon as it is determined that the image forming section of at least one color is installed, it is possible to determined whether the transfer unit 19 is installed or whether the operation of the mounting member 52 is completed regardless of the installation state of the other image forming sections. Since the image forming sections 21Bk, 21Y, 21M, and 21C are not moved from the installation position at a time of printing, the sensor outputs from the toner sensors 30Bk, 30Y, 30M, and 30C and the transfer current are used as determination parameters to determine the installation states of the transfer unit 19 and the image forming sections 21Bk, 21Y, 21M, and 21C and the mounting member 52.

In the first embodiment, where none of the transfer currents for the respective colors, it is possible that the transfer unit 19 is not installed, none of the image forming sections 21Bk, 21Y, 21M, and 21C are not installed, and that the operation of the mounting member 12 (FIG. 1) is not completed and at least the image forming sections 21M and 21C are not installed. Thus, the determination device determines whether the toner sensor for at least one color detects the toner. Where the toner sensor for at least one color detects the toner, it determines that the transfer unit 19 is not installed. Where none of the toner sensors 30Bk, 30Y, 30M, and 30C detect the toner, it determines that none of the image forming sections 21Bk, 21Y, 21M, and 21C are not installed. Consequently, at this stage it is impossible to determine whether the operation of the mounting member 12 is completed.

Thus, the determination device determines whether UNDETECTABLE's of the transfer currents for black and yellow are saved in the memory. If UNDETECTABLE's of the transfer currents for black and yellow are saved, it determines whether UNINSTALLATION's of the black and yellow image forming sections 21Bk and 21Y are saved. If UNINSTALLATION's of the black and yellow image forming sections 21Bk and 21Y are not saved, it determines that the operation of the mounting member 12 is not completed.

By contrast, according to the second embodiment, if the transfer unit 19 is installed, it is unnecessary to determine whether UNINSTALLATION's of the black and yellow image forming sections 21Bk and 21Y are saved even though the operation of the mounting member 52 is not completed. Thus, the determination device determines whether the toner sensor for at least one color detects the toner. If the toner sensor for at least one color detects the toner, it determines that the transfer unit 19 is not installed. If none of the toner sensors 30Bk, 30Y, 30M, and 30C detect the toner, it determines whether UNDETECTABLE's of the transfer currents for all colors are saved. If UNDETECTABLE's of the transfer currents for all colors are saved, it determines that none of the image forming sections 21Bk, 21Y, 21M, and 21C are installed. If UNDETECABLE of the transfer current for at least one color is saved, it determines that the operation of the mounting member 52 is not completed. Thus, the determination process by the determination device is simplified.

Where the transfer unit 19 is installed, as soon as it is determined that the image forming section for at least one color is installed, it is possible to determine that the transfer unit 19 is installed and the operation of the mounting member 52 is completed regardless of the installation of the other image forming sections. Consequently, it is possible to quickly determine whether the image forming sections 21Bk, 21Y, 21M, and 21C are installed. When the transfer unit 19 is placed at an uninstallation position, there are provided sufficient spaces between the respective transfer rollers 15Bk, 15Y, 15M, and 15C and the respective contact members 26Bk, 26Y, 26M, and 26C to prevent current leaks as transfer currents, thereby increasing the precision of determination by the determination device.

Figure 16:
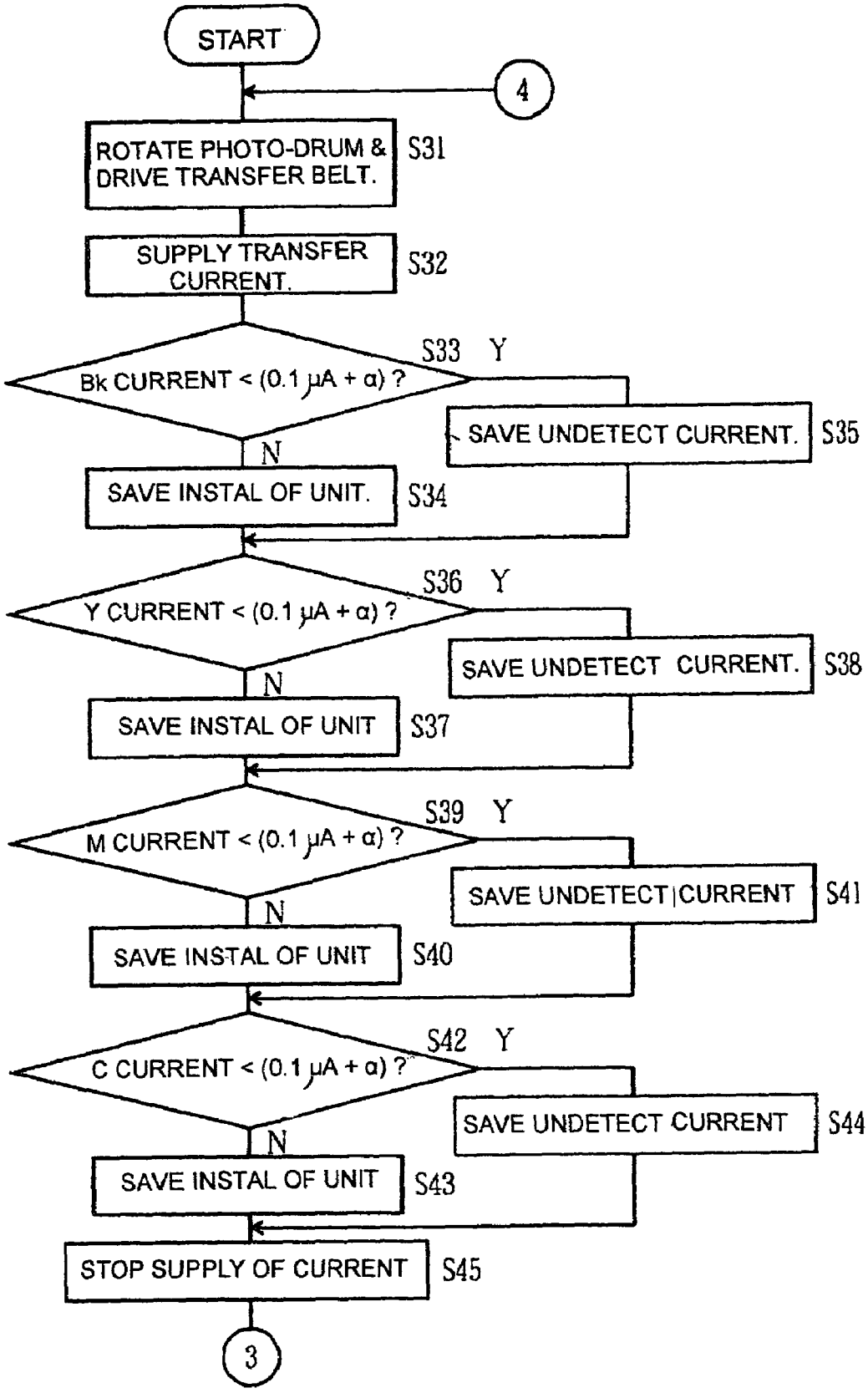
FIG. 16 is the first flow chart showing a process for determining the mounting state.
Figure 17:
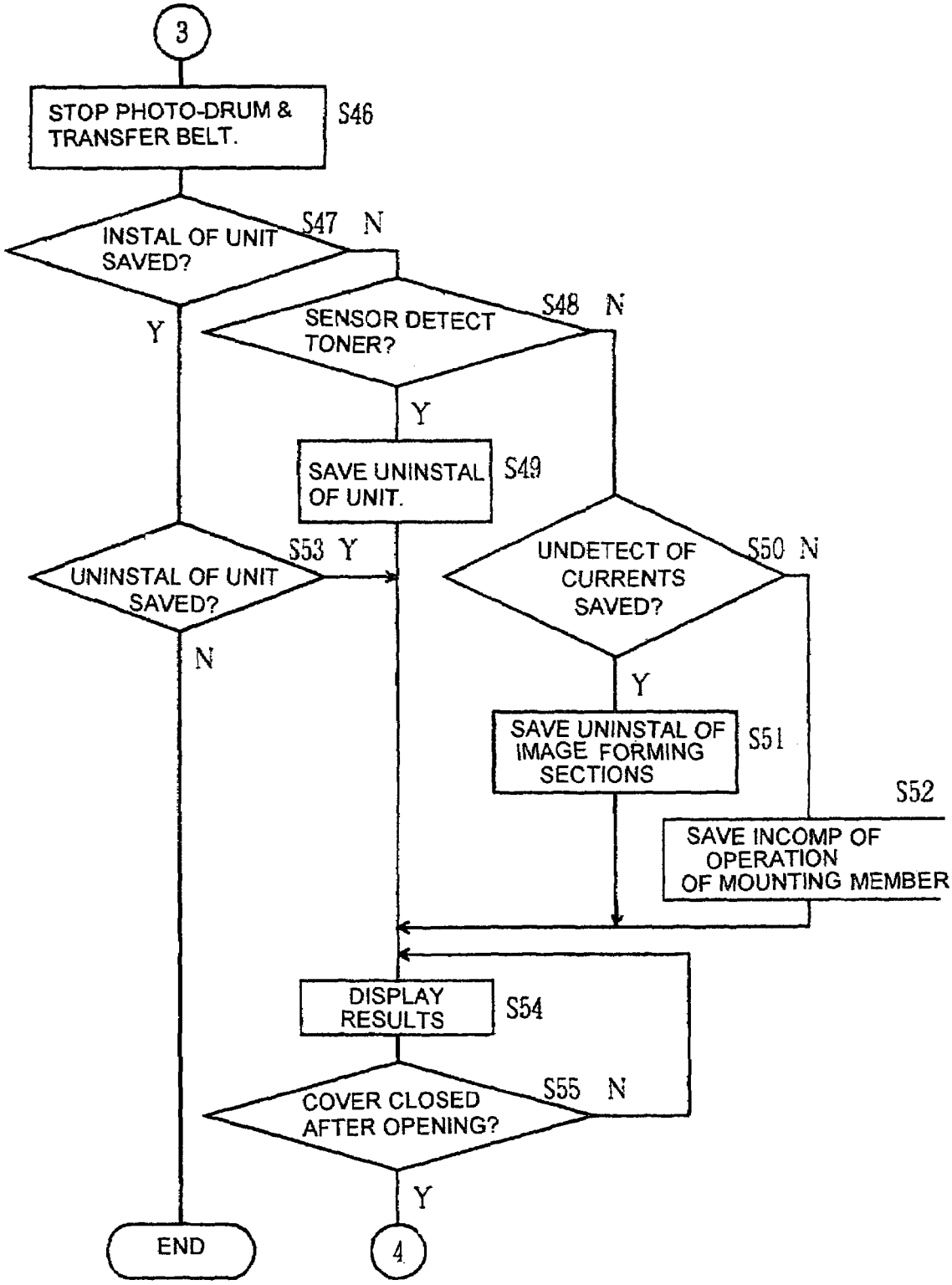
FIG. 17 is the second flow chart showing the process for determining the mounting state.

The determination process will be described with reference to FIGS. 16 and 17.

At a step S31, rotation of the photosensitive drums 11Bk, 11Y, 11M, and 11C and running of the transfer belt 16 are started.

At a step S32, transfer currents for respective colors are supplied.

At a step S33, whether the black transfer current is below 0.1 μA+α is determined. If it is below 0.1 μA+α, the process goes to a Step 35 and, otherwise, to a step S34.

At the step S34, INSTALLATION of the transfer unit 19 is saved.

At the step S35, UNDETECTABLE of the transfer current is saved.

At a step S36, whether the yellow transfer current is below 0.1 μA+α is determined. If it is below 0.1 μA+α, the process goes to a step S38 and, otherwise, to a step S37.

At the step S37, INSTALLATION of the transfer unit 19 is saved.

At the step S38, UNDETECTABLE of the transfer current is saved.

At a step S39, whether the magenta transfer current is below 0.1 μA+α is determined. If it is below 0.1 μA+α, the process goes to a Step 41 and, otherwise, to a step S40.

At the step S40, INSTALLATION of the transfer unit 19 is saved.

At the step S41, UNDETECTABLE of the transfer current is saved.

At a step S42, whether the cyan transfer current is below 0.1 μA+α is determined. If it is below 0.1 μA+α, the process goes to a Step S44 and, otherwise, to a step S43.

At the step S43, INSTALLATION of the transfer unit 19 is saved.

At the step S44, UNDETECTABLE of the transfer current is saved.

At a step S45, supply of the transfer current for each color is terminated.

At a step S46, rotation of the photosensitive drums 11Bk, 11Y, 11M, and 11*c* and running of the transfer belt 16 are stopped.

At a step S47, whether INSTALLATION of the transfer unit 19 is saved is determined. If INSTALLATION of the transfer unit 19 is saved, the process goes to a step S53 and, otherwise, to a step S48.

At the step S48, whether the toner sensor for at least one color detects the toner is determined. If the toner sensor for at least one color detects the toner, the process goes to a step S49 and, otherwise, to a step S50.

At the step S49, UNINSTALLATION of the transfer unit 19 is saved.

At the step S50, whether UNDETECTABLE's of the transfer currents for all colors are saved is determined. If UNDETECTABLE's of the transfer currents for all colors are saved, the process goes to a step S51 and, otherwise, to a step S52.

At the step S51, UNINSTALLATION's of all the image forming sections 21Bk, 21Y, 21M, and 21C are saved.

At the step S52, IMCOMPLETION of the operation of the mounting member 52 is saved.

At a step S53, whether UNINSTALLATION of the unit is saved is determined. If UNINSTALLATION of the unit is saved, the process goes to a step S54 and, otherwise, to an END.

At the step S54, the determination results are displayed.

At a step S55, whether the cover is closed after opening is determined. If the cover is closed after opening, the process returns to the step S31 and, otherwise, to the step S54.

The operation of the mounting member 52 is completed by pressing the developing roller 52 to the engaging section 56. Alternatively, it is possible to press the respective transfer rollers 15Bk, 15Y, 15M, and 15C or other projections of the transfer unit 19 to the engaging sections 56 and 57. A separation facilitating member, such as a spring, may be used to separate the transfer rollers 15Bk, 15Y, 15M, and 15C from the voltage supply 13. In the above first and second embodiments, where paper 27 remains in the body 48 for poor transportation, the control section 20 controls the transfer current by taking the resistance component of the paper 27 into account. It is understood that the invention is not limited to the above illustrated embodiments. A variety of modifications may be made according to the sprit of the invention but fall within the scope of the invention.

The invention claimed is:

1. An image forming apparatus including a body, comprising:

at least one image bearing body provided within said body for forming an electrostatic latent image;

a transfer unit provided within said body and having at least one transfer section opposed to said image bearing body;

a voltage supply for generating a transfer voltage;

a mounting member for bringing said transfer section into contact with said image bearing body when said transfer unit is installed at an appropriate position within said body and into non-contact with said image bearing body when said transfer unit is installed at an inappropriate position within said body; and a detection unit for applying said transfer voltage to said transfer section to detect whether said transfer unit is in contact with said image bearing body.

2. The image forming apparatus according to claim 1, which further comprises:

a first determination unit for determining, based on detection results by said detection unit, whether said transfer unit is installed and a second determination unit for determining whether a consumption article is new or old when said transfer unit is determined to be installed.

3. The image forming apparatus according to claim 1, which further comprises:

a first determination unit for determining, based on detection results by said detection unit, whether said transfer unit is installed and a retrieval unit for retrieving management information when said transfer unit is determined to be installed.

4. The image forming apparatus according to claim 1, which further comprises:

a first determination unit for determining, based on detection results by said detection unit, whether said transfer unit is installed and a display unit for displaying an installation state of said transfer unit when said transfer unit is determined to be not fully installed.

5. The image forming apparatus according to claim 2, wherein said first determination unit determines, based on the detection results by said detection unit, whether said transfer unit is installed and whether an image forming section is installed.

6. The image forming apparatus according to claim 1, wherein said mounting member is provided on said transfer unit and includes an interfering section for interference with said image bearing body and an engaging section for engagement with said body.

7. The image forming apparatus according to claim 1, wherein said mounting member is movable between a fixing position where said transfer unit is brought into contact with said image bearing body for fixation and a release position where said transfer unit is brought into non-contact with said image bearing body.

8. The image forming apparatus according to claim 1, said detection unit determines whether each of said image bearing bodies and said transfer unit is installed based on a combination of detection results of said transfer sections.

9. The image forming apparatus according to claim 1, wherein said transfer unit is installed in a first direction relative to said body and said mounting member moves said transfer unit in a second direction perpendicular to said first direction.

10. The image forming apparatus according to claim 9, wherein said voltage supply is connected to said transfer section when said transfer unit is moved for fixation by said mounting member.

11. An image forming apparatus including a body, comprising:

at least one image bearing body provided within said body for forming an electrostatic latent image;

a transfer unit provided within said body and having at least one transfer section opposed to said image bearing body;

a voltage supply for generating a transfer voltage;

a mounting member for bringing said transfer section into contact with said image bearing body when said transfer unit is installed at an appropriate position within said body and into non-contact with said image bearing body when said transfer unit is installed at an inappropriate position within said body; and a detection unit for applying said transfer voltage to said transfer section to detect whether said transfer unit is connected to said voltage supply.

12. The image forming apparatus according to claim 11, which further comprises:

a first determination unit for determining, based on detection results by said detection unit, whether said transfer unit is installed and a second determination unit for determining whether a consumption article is new or old when said transfer unit is determined to be installed.

13. The image forming apparatus according to claim 11, which further comprises:

a first determination unit for determining, based on detection results by said detection unit, whether said transfer unit is installed and a retrieval unit for retrieving management information when said transfer unit is determined to be installed.

14. The image forming apparatus according to claim 11, which further comprises:

a first determination unit for determining, based on detection results by said detection unit, whether said transfer unit is installed and a display unit for displaying an installation state of said transfer unit when said transfer unit is determined to be not fully installed.

15. The image forming apparatus according to claim 12 wherein said first determination unit determines, based on the detection results by said detection unit, whether said transfer unit is installed and whether an image forming section is installed.

* * * * *